United States Patent [19]

House, Jr.

[11] 4,338,795

[45] Jul. 13, 1982

[54] BEVERAGE INSULATING AND COOLING RECEPTACLE

[76] Inventor: Robert C. House, Jr., 21689 Albion, Farmington Hills, Mich. 48024

[21] Appl. No.: 253,436

[22] Filed: Apr. 13, 1981

[51] Int. Cl.[3] ..... F25D 3/08

[52] U.S. Cl. ..... 62/372; 62/457

[58] Field of Search ..... 62/371, 372, 457, 529, 62/530

[56] References Cited

U.S. PATENT DOCUMENTS

| | | | |
|---|---|---|---|
| 1,999,670 | 4/1935 | Strouse et al. | 62/372 |
| 2,564,165 | 8/1951 | Magis | 62/457 |
| 2,629,515 | 2/1953 | Asplund | 62/371 X |
| 3,273,354 | 9/1966 | Gibson | 62/457 |
| 3,998,072 | 12/1976 | Shaw | 62/372 X |
| 4,078,701 | 3/1978 | Clubb | 62/372 X |
| 4,197,890 | 4/1980 | Simko | 62/372 X |
| 4,255,944 | 3/1981 | Gardner et al. | 62/457 |
| 4,281,520 | 8/1981 | Norwood | 62/372 |

*Primary Examiner*—Lloyd L. King

*Attorney, Agent, or Firm*—Cullen, Sloman, Cantor, Grauer, Scott & Rutherford

[57] ABSTRACT

An insulating and cooling receptacle for a beverage bottle comprises an insulating base portion and a bottle-cooling cap portion which is filled with a freezable substance. The cap is removable to permit insertion or removal of a bottle and to permit the cap portion to be separately pre-frozen prior to use. The cap portion is dimensioned to permit the top of the bottle to project through its open top so that the user may drink or pour from the open bottle while the bottle is cooling and insulated within the receptacle.

4 Claims, 1 Drawing Figure

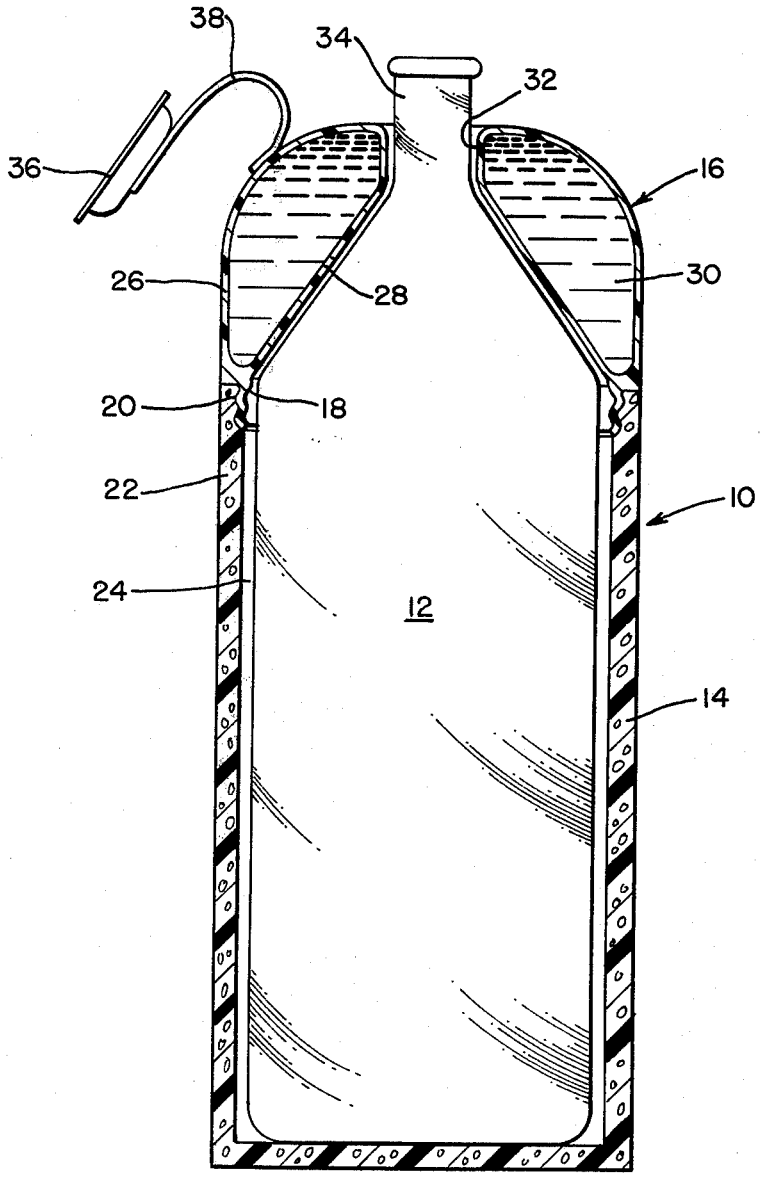
38
34
32
36
16
26
28
30
20
18
22
10
24
12
14

BEVERAGE INSULATING AND COOLING RECEPTACLE

BACKGROUND AND SUMMARY OF THE INVENTION

A variety of insulating and cooling receptacles for beverage containers have been suggested in the prior art. For example, U.S. Pat. No. 3,302,428 shows a mug-like container for a beverage-holding can. The receptacle is completely open at its top to permit the can to extend above its upper lip, while the side walls and base of the receptacle are lined by a chamber containing a freezable substance. Therefore, the complete, rather voluminous, receptacle must be placed in a freezer in order to pre-freeze the substance prior to use. Furthermore, because the receptacle lacks a removable top portion, it is not suitable for use in insulating and cooling conventionally shaped bottles.

U.S. Pat. No. 3,273,354 shows an insulated receptacle for a beverage container which includes a removable cover containing the freezable substance. This receptacle, however, is suitable only for storage of the beverage container, and contains no suggestion or means for permitting pouring or drinking while the beverage is insulated and cooled by the receptacle.

Other patents, such as U.S. Pat. No. 3,998,072 and German Offenlegungsschrift No. 23 35 041, disclose beverage coolers having removable sections containing the freezable liquid. However, these patents fail to suggest or disclose a beverage insulating and cooling receptacle which is constructed to permit the user to conveniently drink from the beverage bottle while the bottle is being insulated and cooled within the receptacle, with the receptacle being readily held in one hand. Other relevant patents which similarly fail to provide the above features are U.S. Pat. Nos. 2,564,165 and 3,434,302.

Accordingly, it is the principle object of the present invention to provide an improved insulating and cooling receptacle for a conventionally shaped beverage-containing bottle which (1) provides maximum volume for a freezable substance, (2) is dimensioned and shaped to permit the top of a bottle to project above the top of the receptacle so that the user may drink or pour from the bottle while it is within the receptacle, (3) is small enough to permit the user to readily hold the receptacle in one hand while drinking from the bottle, (4) provides means for retaining the bottle even when the receptacle and bottle are inverted during pouring or drinking.

These objectives have been accomplished in the present invention by placing the reservoir for the freezable substance in a separate removable cap portion which is shaped to follow the contour of the narrow neck portion of the bottle. This shape has several advantages. It makes use of the annular volume surrounding the neck of the bottle to provide maximum volume for the coolant without increasing the exterior diameter of the receptacle, thereby facilitating gripping of the receptacle by one hand. This shape also permits the receptacle cap to retain the bottle within the receptacle even when the receptacle is inverted. The placement of the freezable substance at the top of the receptacle acts in several ways to provide maximum cooling effect upon the beverage. Convection of air in the annular air space between the bottle and the interior of the receptacle tends to carry cold air downward along the full length of the bottle, thereby cooling portions of the bottle remote from the cap. Because all of the beverage poured from the container will pass through the cooled upper portion of the bottle immediately before it exits from the bottle, it receives a final cooling as it leaves the bottle. Furthermore, the repeated tilting or inversion of the bottle during pouring aids in repeatedly circulating the beverage still within the bottle past the cooled upper portion of the bottle.

BRIEF DESCRIPTION OF THE DRAWINGS

The FIGURE shows the receptacle of the present invention in cross-sectional elevation and containing a conventionally shaped bottle.

DETAILED DESCRIPTION OF THE INVENTION

Referring to the FIGURE, the improved insulating and cooling receptacle 10 is shaped so that its interior closely conforms to the shape of a conventional beverage bottle 12. The receptacle generally comprises a cylindrical insulating base portion 14 and a double-walled cooling cap portion 16. Cap 16 is provided with a downwardly projecting circumferential flange 18 preferably dimensioned to be snugly received within the open top of base 14. Appropriate connecting means such as threads 20 or other kinds of cooperating formations are provided to removably secure cap 16 to base 14.

Base side wall 22 is preferably cylindrical in shape and dimensioned to leave a narrow annular air space 24 between wall 22 and bottle 12. The dimensions are selected to provide such an insulating air space while at the same time making such space minimal so that the bottle will not have a disconcerting tendency to slide back and forth within the receptacle and also so that the external diameter of base 14 is sufficiently small to permit easy gripping by one hand. Base 14 is preferably fabricated of a material having insulating qualities, such as foamed plastic, as will be understood by those skilled in the art.

Cap portion 16 is formed of concentric outer and inner walls 26, 28, respectively, which are joined at their upper and lower extremities and define therebetween a fluid-tight annular chamber 30 which is permanently filled with a freezable substance. The freezable substance may be water or other suitable material such as a water solution of glycerin or a plastic gel such as "Blue Ice" which can be readily frozen and which has the appropriate physical properties for use in this application, as will be understood by those skilled in the art.

A central opening 32 is provided at the top of cap 16 to permit neck 34 of bottle 12 to project above the receptacle so that the beverage can be readily poured from the bottle into a drinking receptacle or so that the user may place the top of the bottle directly in his mouth.

It will be noted from the FIGURE that inner wall 28 of cooling cap 16 is shaped and dimensioned to closely follow the conical shape of the neck of the bottle. This configuration provides maximum volume of chamber 30 for a given external diameter of the receptacle. At the same time, the upwardly converging shape of cap 16 functions to retain bottle 12 within receptacle 10 even when the receptacle is inverted for pouring or drinking, and minimizes any tendency of the bottle to disconcertingly shift within the receptacle.

Cap portion 16 is preferably formed of a suitable plastic such as polyethylene, and can readily be fabricated by the blow molding process.

The confinement of the freezable substance within the removable cap provides the additional convenience of permitting the substance to be pre-frozen prior to use merely by placing the compact cap, without the more voluminous base portion, in a freezer with minimum comsumption of space.

The fabrication of the receptacle in two separate portions provides the additional advantage of permitting interchangeable assembly of base portions of differing lengths with cap portions of differing internal shapes. In this way, a user could have a set of interchangeable bases and caps from which he could select the two components best dimensioned and shaped for use with any one of the variety of standard-shaped beverage bottles.

As an added optional convenience feature, a snap-on bottle cap 36 may be permanently secured to cap portion 16 by a flexible strap 38. Strap 38 could be secured to cap portion 16 by solvent or sonic welding or other well known techniques.

This invention may be further developed within the scope of the following claims. Accordingly, the above specification is to be interpreted as illustrative of only a single operative embodiment of the present invention, rather than in a strictly limited sense.

I now claim:

1. An insulating and cooling receptacle for a beverage-containing cylindrical bottle of the type having an elongated tapering neck terminating in a top portion of a diameter which is significantly less than that of the main body of the bottle, which comprises:

a hollow cylindrical base portion having an open top and dimensioned so its internal diameter leaves a thin annular air gap between the side walls of said base portion and the beverage bottle to be removably received therein, said base portion being further dimensioned so its height substantially corresponds with the height of the straight-sided cylindrical portion of said beverage bottle;

a cap portion dimensioned to be removably secured to the open top of said base portion and of sufficient height to permit only enough of the top portion of the beverage bottle to project therefrom as is required to comfortably permit beverage to be poured from the bottle or to be drunk directly therefrom while the bottle is contained within the receptacle, said cap portion having a centrally located opening at its top to permit said projection of the top portion of the bottle, said cap portion having inner and outer concentric walls joined together near their upper and lower extremities to create a fluid-tight annular chamber therebetween which is permanently filled with a freezable substance, said outer wall being generally cylindrical to form an upward extension of said base portion side walls when secured thereto, said inner wall being generally conical and converging upwardly from a lower junction with said outer wall toward an upper junction at said cap portion opening with a radially inwardly extending portion of said outer wall, said inner wall being shaped and dimensioned to be closely spaced from the tapered neck of the bottle, thereby permitting maximum enclosed volume within said annular chamber for a given external diameter of said base portion; and means for removably securing said cap portion to said base portion.

2. The receptacle of claim 1 wherein the lower extremity of said cap portion has a circumferential downwardly projecting flange which is dimensioned to be received within the open top of said base portion, said flange and the opposed upper inner surface of said base portion side walls having cooperating formations to releaseably secure said cap portion and base portion together.

3. The receptacle of claim 1 wherein said base portion is formed of an insulating material.

4. The receptacle of claim 1 wherein the outer diameter of said base portion is dimensioned to permit the receptacle to be comfortably gripped by one hand.

* * * * *